United States Patent [19]

Booi

[11] 4,143,493

[45] Mar. 13, 1979

[54] WINDOW FRAME STRUCTURE

[75] Inventor: Arie Booi, Milton, Canada

[73] Assignee: Repla Designs Limited, Oakville, Canada

[21] Appl. No.: 874,087

[22] Filed: Feb. 1, 1978

[30] Foreign Application Priority Data

Dec. 16, 1977 [CA] Canada ..... 293298

[51] Int. Cl.[2] ..... E04B 1/66; E06B 1/04

[52] U.S. Cl. ..... 52/127; 52/398; 52/656; 52/788; 52/309.13; 403/231

[58] Field of Search ..... 52/127, 398, 397, 788, 52/789, 790, 822, 656, 309.13; 403/220, 231

[56] References Cited

U.S. PATENT DOCUMENTS

| | | | |
|---|---|---|---|
| 2,169,713 | 8/1939 | Stroud | 52/399 |
| 3,082,490 | 3/1963 | Loucks | 52/656 X |
| 3,324,599 | 6/1967 | Brost | 52/656 X |
| 3,340,665 | 9/1967 | Kohl | 52/656 |
| 3,410,040 | 11/1968 | Biro et al. | 52/656 X |
| 3,411,247 | 11/1968 | Fleming | 52/790 X |
| 3,881,290 | 5/1975 | Bouchey | 52/397 |

FOREIGN PATENT DOCUMENTS

| | | | |
|---|---|---|---|
| 1227745 | 3/1960 | France | 52/656 |
| 782358 | 9/1957 | United Kingdom | 52/657 |

*Primary Examiner*—Alfred C. Perham
*Attorney, Agent, or Firm*—Sughrue, Rothwell, Mion, Zinn and Macpeak

[57] ABSTRACT

An improved window structure is provided which has an external and internal frame surrounding a plural glazed sealed element. The internal frame has abutting joints. The junction between the abutting frame members is accomplished by a screw engaging a tongue. The tongue is capable of movement to compensate for temperature variations or relative movement between frame members.

10 Claims, 9 Drawing Figures

FIG.1.
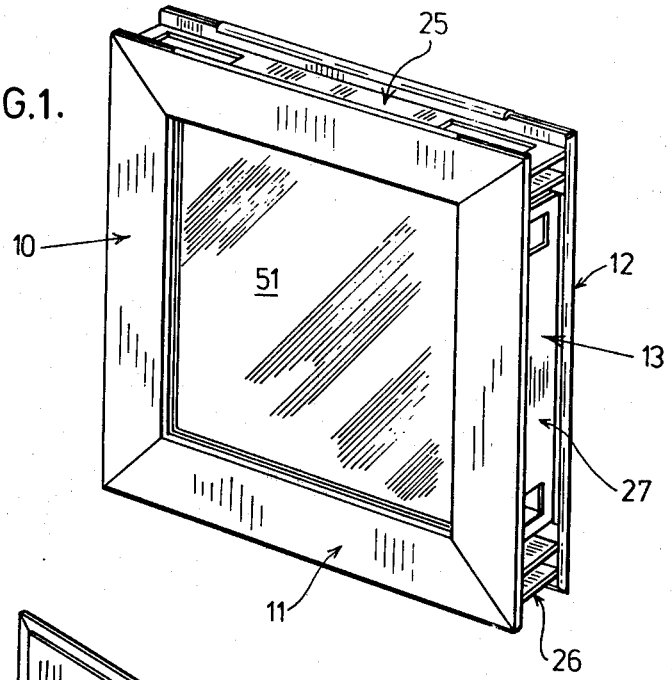
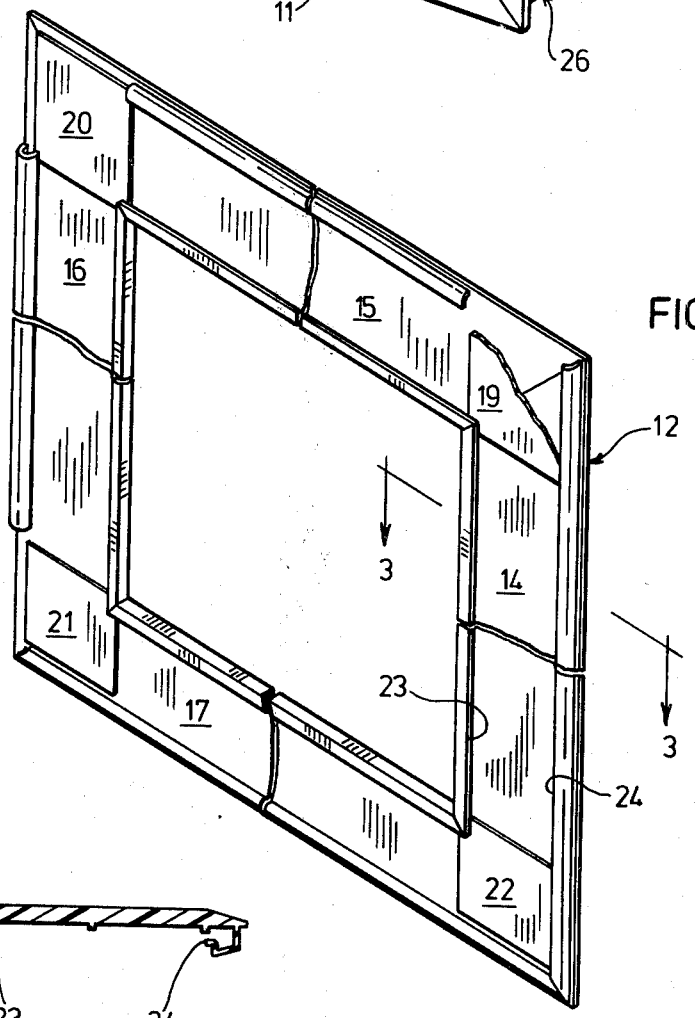
FIG.2.
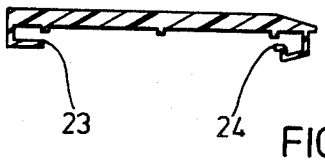
FIG.3.

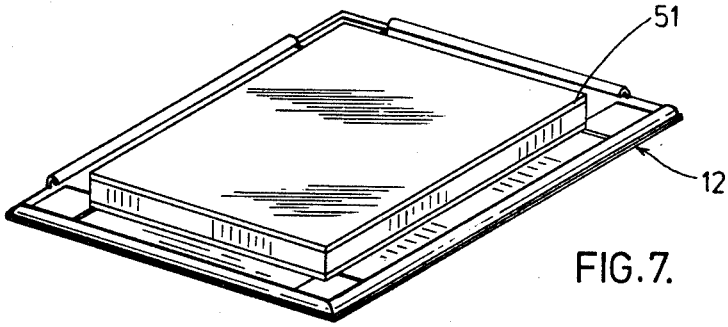
FIG. 7.
FIG. 8.
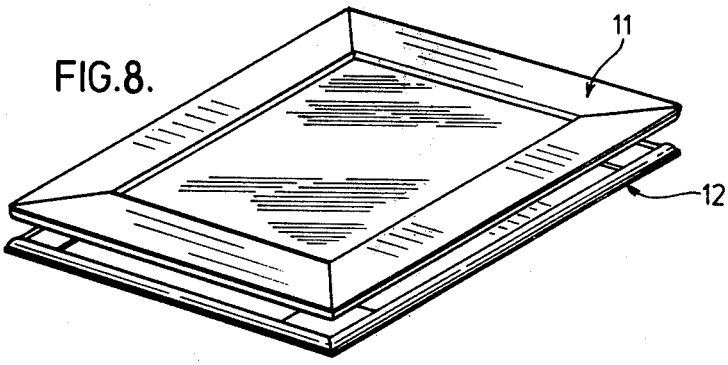
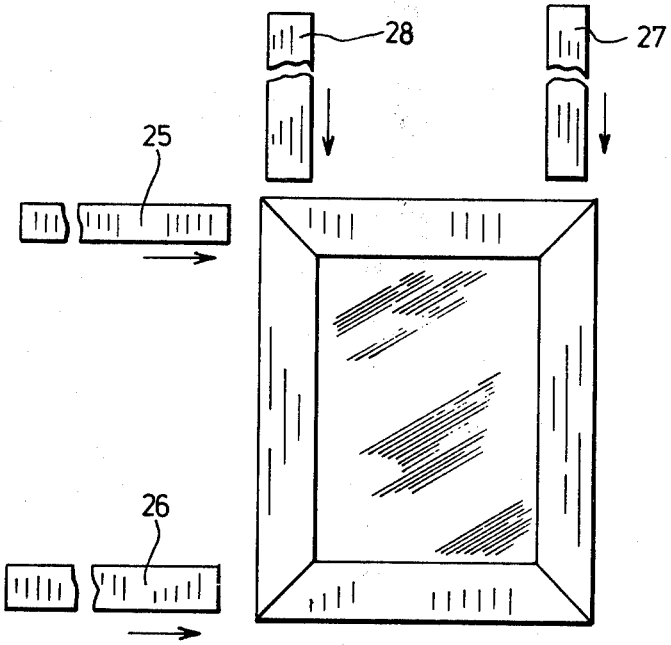
FIG. 9.

WINDOW FRAME STRUCTURE

BACKGROUND OF THE INVENTION

This invention relates to windows and more particularly to heat insulating window units composed of a plurality of sheets of glass spaced apart from each other.

The increasing use of metal frames, particularly aluminium, has given rise to many new window structures. These structures, in endeavours to overcome various problems which have arisen, have become more complex.

These problems have arisen in three main areas: ease of assembly, cost and performance.

The difficulties in assembly are of course related to the cost. The more complex structures require expensive extrusions, hardware, special jigs for manufacture and a considerable number of man-hours.

Costs have risen because of the complexities previously referred to and becuase of the increased quantities of materials that these prior structures have required.

And, finally, these more complex structures have not always led to improved performance. The most common problems have been the insulation factor and the capacity to withstand wide temperature fluctuations. This latter problem has been very prevalent in metal framed glazed building structures with mitred corners since the adjacent components tend to migrate and stress the frame.

SUMMARY OF THE INVENTION

It is the principal object of the present invention to provide a window structure which is easy to assemble, economical in materials and which has the capacity to withstand wide temperature variations without damage while presenting a pleasant, attractive appearance.

In accordance with the present invention, there is provided a glazed building unit comprising a glazed element comprising at least a pair of parallel sheets of glass and means supporting said sheets in a spaced-apart sealed relationship; a pair of external frame members overlying the edges and having an outer periphery extending beyond the periphery of said glazing element; each of said frame members having an internal and an external edge, and an inwardly extending channel along each of said edges; structural members surrounding said glazing element and between said external frame members each said structural member having legs engageable with an adjacent channel of said external members; and means connecting adjacent ones of said frame members in a temperature-compensating relationship.

The structure which has just been described permits easy assembly, strength and has a capacity to compensate for extremely high temperature variations without any great stress or distortion. These features and others will be made apparent from the following description and drawings in which a preferred embodiment is illustrated and in which:

FIG. 1 is a general perspective view of a glazed building unit in accordance with the present invention;

FIG. 2 is a general perspective view, partly fragmented, of an external frame member employed in a glazed building unit in accordance with the present invention;

FIG. 3 is a section taken along line 3—3 of FIG. 2 and serves to illustrate the structure and composition of the external frame member illustrated in FIG. 2;

FIGS. 7, 8 and 9 show the sequence of assembling a glazed building unit in accordance with the present invention.

Figure 6:
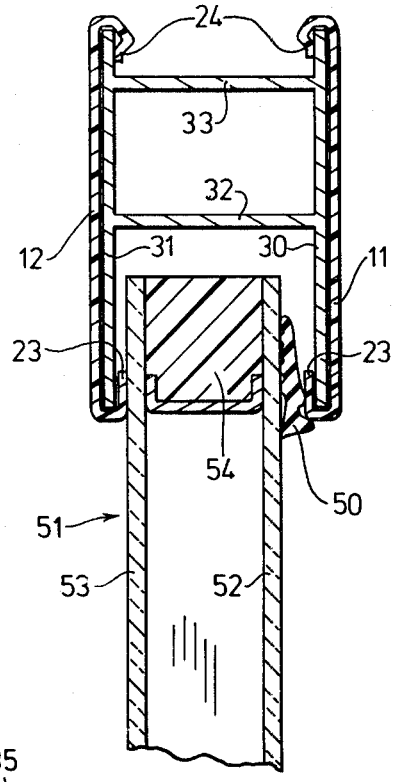
FIG. 6 is a section taken along line 6—6 of FIG. 5.

Referring now to the drawings, a glazed building unit in accordance with the present invention is generally indicated at 10 in FIG. 1.

It is to be observed that for the purposes of this specification that the term glazed building unit is defined and employed to describe a structure which may be employed as a window or as a door of either the sliding or hinged species. It will also be noted that the structure to be described may be employed by itself or by being built into a further building component such as a door. It may also, depending on the hardware employed, be used in any of the usual manners as a door or a window depending on its dimensions.

As illustrated in FIG. 1, a glazed building component 10 in accordance with the present invention comprises a pair of external frame members 11 and 12 which surround and extend beyond an internal frame 13. This frame in turn surrounds a double glazed sealed unit 51. This glazed unit 51 comprises a pair of glass plates 52 and 53 spaced apart and sealed about their periphery by a block 54 and sealed in any conventional manner.

The external frame members 11 and 12 are preferably extruded polyvinyl chloride mouldings having a section such as illustrated in FIG. 3.

Each frame member such as 12 in FIG. 2 is the mirror image of its partner, for example 11 and 12, and each comprises four planar members such as 14, 15, 16 and 17 which are mitre jointed as at and secured by corner plates such as 19, 20, 21 and 22.

On the inner and outer edges of each member there is provided an inwardly extending channel 23 and 24, respectively. Longitudinal reinforcing ribs may also be provided. On the inner edge the channels 23 form a continuous channel. However, the outer channel 24 is not continuous. On the top edge the channel 24 is spaced apart from the outer periphery at both ends a distance equal to the width of the vertical runs 27 and 28 and on one vertical edge the outer channel 24 is similarly spaced apart from the outer peripheries.

These external frame members are, as previously mentioned of plastic, and due to the gauge may be considered as flexible or semi-rigid. For aesthetic appearances they may also be provided in any suitable or desired colour.

Internally of frame members 11 and 12 the internal frame 13 is provided. This frame 13 comprises, in the embodiment illustrated, four members, an upper run 25, a lower run 26 and two vertical runs 27 and 28.

Each of these runs has a substantially similar basic structure with the upper and lower runs 25 and 26 being identical and the vertical runs 27 and 28 being identical.

Figure 4:
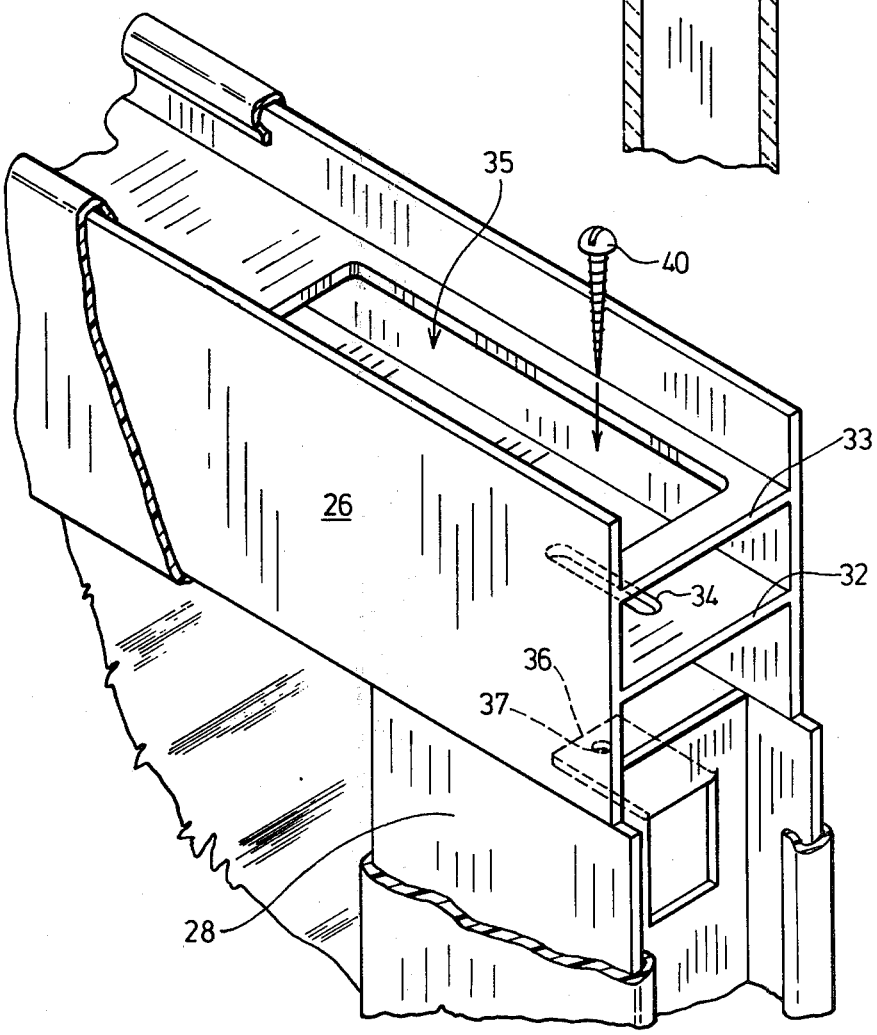
FIG. 4 is an enlarged perspective view, partly broken away and partly exploded, to show a corner structure of a glazed building unit in accordance with the present invention.
Figure 5:
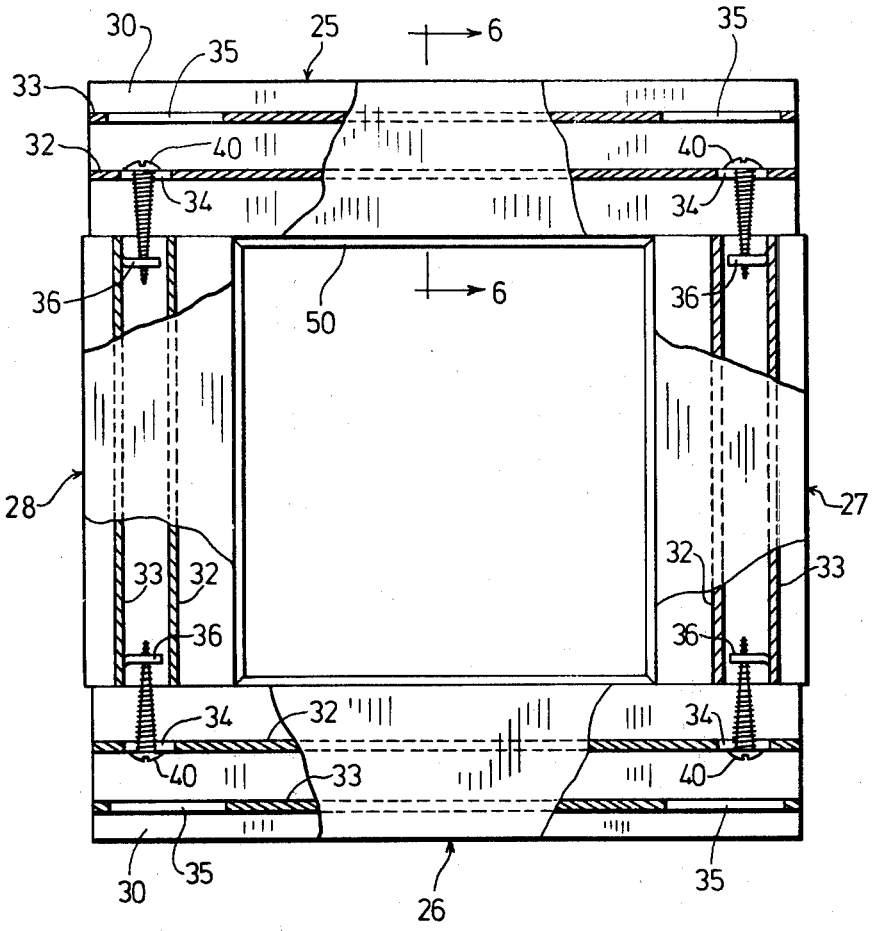
FIG. 5 is a plan view of a glazed building unit in accordance with the present invention with the external frame partly broken away and partly in section to illustrate the relationship between the inner frame members.

As shown in FIGS. 4, 5 and 6, the basic structure of these runs has, what may be termed for the purposes of this description, a doubled-barred H-structure. That is, each comprises a pair of spaced-apart parallel legs 30 and 31 with transverse spaced-apart bars 32 and 33 extending therebetween.

However, as illustrated in FIGS. 4 and 5 adjacent each of the ends of the upper and lower runs 25 and 26 transverse bar 32 is provided with an elongate slot 34, and bar 33 is provided with enlarged aligned access holes 35.

The vertical runs 27 and 28 are, as mentioned previously, identical with the same double-barred H-structure. However, from adjacent each end their transverse bars 33 a tongue such as 36 is struck out and bent inwardly. This tongue 36 is provided with a threaded hole illustrated in FIG. 4 and identified as 37.

When the structure has been assembled in a manner to be described presently, legs 30 and 31 engage with the inwardly extending channels 24 and 23 on the external frame members 11 and 12 as illustrated in FIGS. 4 and 6.

The vertical runs 27 and 28 are in an end abutting relationship with the upper and lower runs 25 and 26, slots 34 are aligned with the threaded holes 36 and screws such as 40 are passed through slots 34 engaged with hole 36 and the whole assembly made fast.

A flexible weatherproof gasket or seal 50 is then inserted around the future external periphery of the junction between the external frame member 11 and the adjacent glass surface 52.

It will be noted, particularly from FIG. 4, that the vertical runs 27 and 28 project slightly beyond the ends of the upper and lower runs 25 and 26.

As is well known when the aluminium or metal members 25, 26, 27 and 28 expand or contract, the junctions between these members is strained. However, with the present structure in the event that there is expansion of these members, the structure compensates for such expansion if the upper and lower runs 25 and 26 are caused to extend, then screw 40 may migrate along slot 40 and tongues 36 may also be caused to be bent towards the respective upper and lower runs 25 and 26.

Normally, expansion will occur simultaneously in all four internal frame members and as 27 and 28 lengthen so do 25 and 26 tongues 36 will bend towards their respective ends.

With contraction as in cold weather, the reverse action takes place, with tongue 36 pulling screw 40 inward and it may at the same time migrate towards the inner end of slots 34.

Thus, it will be seen that the joints remain firm and tight irrespective of the conditions.

Quite apart from the temperature compensations, the absence of the mitre is more economical because there is a considerable saving in the material cost of the extrusions. It will be appreciated that the extrusion cost is considerably reduced because this structure saves the equivalent of the material of four corner pieces. With aluminium extrusions after the initial die costs the cost is in the weight of aluminium employed. This structure due to less wastage has the further advantage of economy.

Finally, there is a considerable saving in assembly costs with minimal hardware. As has been demonstrated, only four screws are required to complete the assembly; however, the assembly is itself, as will be evidenced from the following description, very simple.

Referring now to FIGS. 7, 8 and 9, the external frame member 12 is placed on a flat surface and then the double-glazed sealed unit or element is placed thereover so that the glazing lies over the gap defined by the frame member. The second external frame member 11 is then placed thereover in the manner illustrated in FIG. 8.

The internal frame members are then inserted in the following manner: first, the lower run 26 is passed between the two external frame members 11 and 12 so that the legs 30 and 31 engage the respective channels 24 and 23 in the manner shown in FIG. 6; then both of the vertical runs 27 and 28 are similarly engaged with their corresponding channels 24, 23 on the external frame members 11 and 12; finally the upper frame member 25 is inserted. Screws 40 are then passed through their respective slots 34 and made fast by engagement with the tongues 36.

From the foregoing it will be seen that a glazed building unit structure has been provided which is easy to assemble, economical to produce and which is self-compensating insofar as stress from temperature variations which may arise. At the same time the external frame provides a tie while giving a pleasant appearance.

While the present invention has been described with reference 15 a specific embodiment of a window, it will be apparent that it will be applicable to other forms of building components.

I claim:

1. A glazed building unit comprising:

a glazing element comprising at least a pair of parallel sheets of glass and means supporting said sheets in a spaced-apart sealed relationship;

a pair of external frame members overlying the edges and having an outer periphery extending beyond the periphery of said glazing element;

each of said frame members having an internal and an external edge, and an inwardly extending channel along each of said edges;

internal frame members surrounding said glazing element and between said external frame members, each said internal frame member having legs engageable with an adjacent channel of said external members; and means connecting adjacent ones of said frame members in a temperature-compensating relationship.

2. A glazed building unit as claimed in claim 1 further including a flexible sealing member extending about an inner periphery of one of said external frame members and frictionally engaged between said frame member and an adjacent surface of said glazing element.

3. A glazed building unit as claimed in claim 1 wherein said internal frame members comprise upper and lower run members and a pair of vertical members, said vertical members having ends in a normal abutting engagement with and adjacent horizontal edges of said upper and lower run members.

4. A glazed building unit as claimed in claim 3 wherein said internal frame members each comprise a pair of spaced-apart legs and at least one transverse member extending therebetween.

5. A glazed building unit as claimed in claim 4 in which said internal frame members each include an outer and an inner spaced-apart transverse member extending between said legs; said upper and lower members each having at each end thereof an access slot in said outer transverse member and an aligned elongate slot in said inner transverse member; said vertical runs each having a tongue adjacent each end thereof with a hole therein, and a threaded member extending between said elongate hole and said hole to connect adjacent runs.

6. A glazed building unit as claimed in claim 5 wherein said tongues on said vertical runs are movable in response to temperature variations.

7. A glazed building unit as claimed in claim 6 wherein said upper and lower runs have a length shorter than the width between the outer edges of said vertical runs.

8. A glazed building unit as claimed in claim 1 wherein said inwardly extending channel on said external edge is spaced apart a predetermined distance from the outer periphery of each of said external frame members.

9. A glazed building unit as claimed in claim 5 wherein said inwardly extending channel on said external edge is spaced apart a predetermined distance from the other periphery of each of said external members.

10. A glazed building unit as claimed in claim 1 wherein said external frame members are of synthetic polymeric material.

* * * * *